US010838338B2

(12) United States Patent
Matsuno et al.

(10) Patent No.: US 10,838,338 B2
(45) Date of Patent: Nov. 17, 2020

(54) IMAGE FORMING APPARATUS INCLUDING A CHIPPED PART TO BLOCK THE TRANSMISSION OF HEAT

(71) Applicant: KYOCERA Document Solutions Inc., Osaka (JP)

(72) Inventors: Akinori Matsuno, Osaka (JP); Takuya Miyamoto, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 16/598,007

(22) Filed: Oct. 10, 2019

(65) Prior Publication Data

US 2020/0117128 A1 Apr. 16, 2020

(30) Foreign Application Priority Data

Oct. 12, 2018 (JP) ..... 2018-193718

(51) Int. Cl.
*G03G 15/00* (2006.01)
*G03G 15/20* (2006.01)

(52) U.S. Cl.
CPC ..... *G03G 15/2064* (2013.01); *G03G 15/2053* (2013.01)

(58) Field of Classification Search
CPC ..... G03G 15/2017; G03G 15/2053; G03G 21/20; G03G 21/206
USPC ..... 399/92, 94, 122
See application file for complete search history.

(56) References Cited

U.S. PATENT DOCUMENTS 9,201,394 B2 * 12/2015 Hiraoka et al. ..... G03G 21/206
9,989,918 B2 * 6/2018 Fujii ..... G03G 21/206
10,185,256 B2 * 1/2019 Inada et al. ..... G03G 15/2017

FOREIGN PATENT DOCUMENTS

JP 2017-129718 7/2017

* cited by examiner

*Primary Examiner* — William J Royer
(74) *Attorney, Agent, or Firm* — Wenderoth, Lind & Ponack, L.L.P.

(57) ABSTRACT

An image forming apparatus includes an image carrying member including a transfer belt or a photosensitive drum, a transfer unit configured to transfer a toner image carried on the image carrying member to a recording medium, a fixing unit disposed above the transfer unit and configured to heat and pressurize the toner image transferred to the recording medium and fix the toner image to the recording medium, a body stay having an opposing wall facing a side surface of the fixing unit, and a positioning part provided on the opposing wall and configured to perform positioning of the fixing unit. A chipped part is provided below the positioning part in the body stay and blocks transmission of heat transmitted from the fixing unit to the body stay via the positioning part.

8 Claims, 9 Drawing Sheets

IMAGE FORMING APPARATUS INCLUDING A CHIPPED PART TO BLOCK THE TRANSMISSION OF HEAT

CROSS-REFERENCE TO RELATED APPLICATION

This application is based upon and claims the benefit of priority from Japanese Patent Application No. 2018-193718 filed on Oct. 12, 2018, the entire contents of which are incorporated herein by reference.

BACKGROUND

The technology of the present disclosure relates to an image forming apparatus.

In the related art, in an electrophotographic image forming apparatus, a toner image carried on an image carrying member is transferred to a recording medium by a transfer unit, and then is heated and pressurized by a fixing unit to be fixed to the recording medium. The image carrying member is configured by a photosensitive drum in the case of a direct transfer system and is configured by an intermediate transfer belt in the case of an intermediate transfer system.

In this type of image forming apparatus, there is a case where the fixing unit is unitized and configured to be detachable from an image forming apparatus body. In such a case, the fixing unit is positioned and fixed to a sheet metal body stay provided in the image forming apparatus body.

The body stay is formed with a pair of positioning engagement holes, and positioning pieces that engage with the engagement holes protrude from the mounting side surface of the fixing unit.

There is a case where a driving roller for driving an intermediate transfer belt is provided below the fixing unit. The driving roller is disposed to face a transfer roller with the intermediate transfer belt interposed therebetween. An abutting part between the intermediate transfer belt and the transfer roller serves as a transfer nip.

Furthermore, there is a case where a cleaning device is provided in the vicinity of the driving roller. The cleaning device has a waste toner unit that collects residual toner attached to the surface of the intermediate transfer belt as waste toner.

SUMMARY

An image forming apparatus according to one aspect of the present disclosure includes an image carrying member, a transfer unit, a fixing unit, a body stay, and a positioning part. The image carrying member includes a transfer belt or a photosensitive drum. The transfer unit is configured to transfer a toner image carried on the image carrying member to a recording medium. The fixing unit is disposed above the transfer unit and is configured to heat and press the toner image transferred to the recording medium and fix the toner image to the recording medium. The body stay has an opposing wall facing a side surface of the fixing unit. A positioning part is provided on the opposing wall and is configured to perform positioning of the fixing unit.

Furthermore, a chipped part is provided below the positioning part in the body stay. The chipped part blocks transmission of heat transmitted from the fixing unit to the body stay via the positioning part.

DETAILED DESCRIPTION

Hereinafter, an example of an embodiment will be described in detail on the basis of the drawings. It is noted that the technology of the present disclosure is not limited to the following embodiments.

Embodiment

Figure 1:
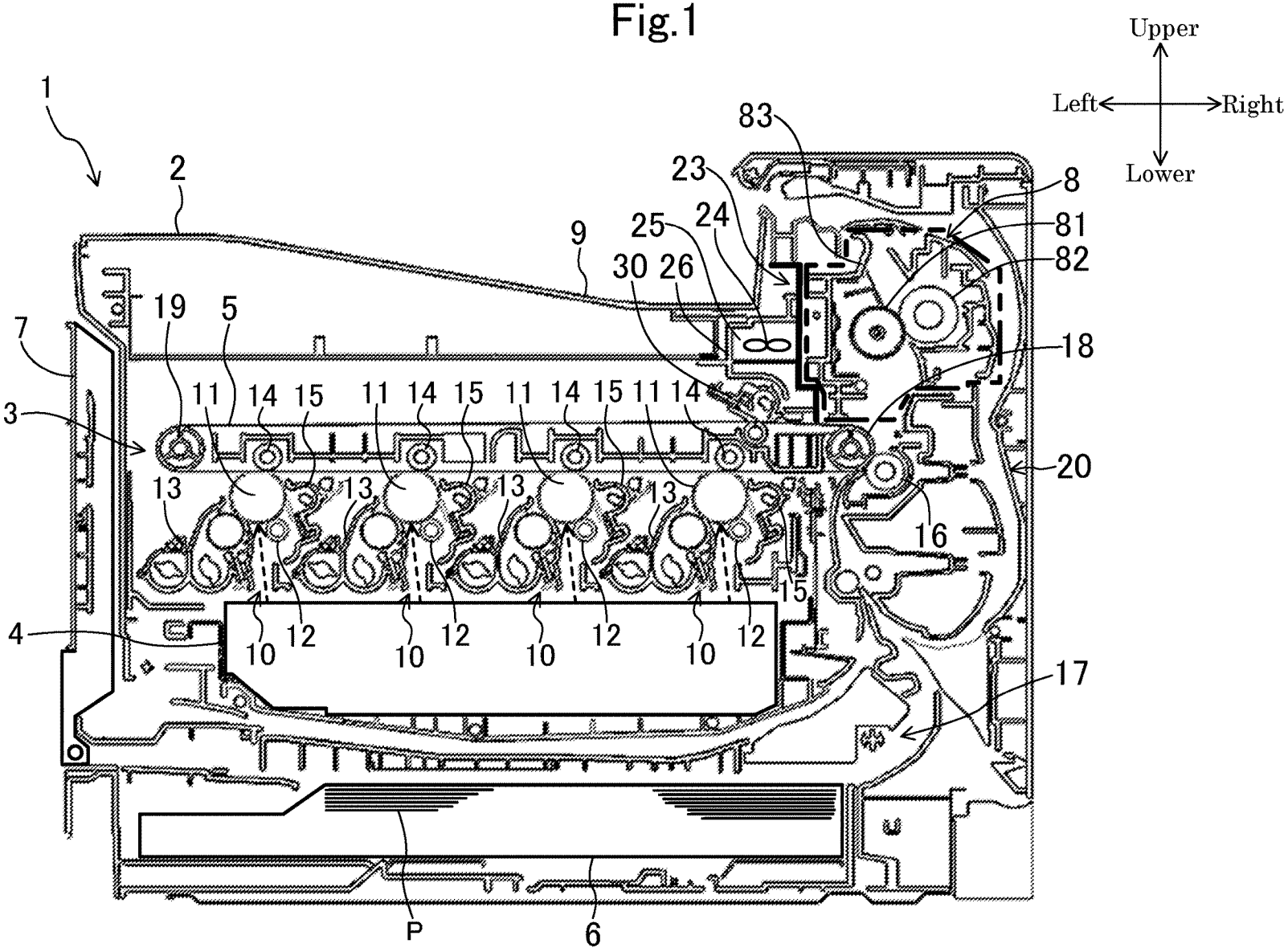
FIG. 1 is a schematic view illustrating an overall configuration of an image forming apparatus in an embodiment.

FIG. 1 illustrates a schematic configuration view of an image forming apparatus 1 according to an embodiment. In the following description, a front side and a rear side indicate a front side and a rear side (a front side and a back side in a direction perpendicular to the paper surface of FIG. 1) of the image forming apparatus 1, and a left side and a right side indicate a left side and a right side when the image forming apparatus 1 is viewed from the front side.

The image forming apparatus 1 is a tandem type color printer and includes an image forming unit 3 in a box-shaped casing 2. The image forming unit 3 transfers an image to a recording sheet P (recording medium) and forms the image on the recording sheet P on the basis of image data transmitted from an external device such as a computer subjected to network connection and the like.

Below the image forming unit 3, an exposure device 4 is disposed to emit laser light, and above the image forming unit 3, an intermediate transfer belt 5 is disposed. The intermediate transfer belt 5 is wound around a driving roller 18 and a driven roller 19 arranged spaced from each other in the right and left direction. The driving roller 18 corresponds to an opposing roller facing a secondary transfer roller 16.

Below the exposure device 4, a sheet storage unit 6 is disposed to store the recording sheet P, and on the left side of the sheet storage unit 6, a manual sheet feeding unit 7 is disposed. On the right upper side of the intermediate transfer belt 5, a fixing unit 8 is disposed to perform a fixing process on the image transferred to and formed on the recording sheet P. Reference numeral 9 denotes a sheet discharge unit that is disposed at an upper part of the casing 2 and discharges the recording sheet P subjected to the fixing process in the fixing unit 8 (a fixing part).

The image forming unit 3 includes four image forming units 10 disposed in a row along the intermediate transfer belt 5. Each of the image forming units 10 has a photosensitive drum 11. Directly below each photosensitive drum 11, a charging device 12 is disposed, and on the left side of each photosensitive drum 11, a developing device 13 is disposed. Directly above each photosensitive drum 11, a primary transfer roller 14 is disposed, and on the right side of each photosensitive drum 11, a cleaning unit 15 is disposed to clean the peripheral surface of the photosensitive drum 11.

The peripheral surface of each photosensitive drum 11 is uniformly charged by the charging device 12, and laser light corresponding to each color based on the image data input from the aforementioned computer and the like is emitted to the charged peripheral surface of each photosensitive drum 11 from the exposure device 4, so that an electrostatic latent image is formed on the peripheral surface of each photosensitive drum 11. A developer is supplied to the electrostatic latent image from the developing device 13, so that a toner image of yellow, magenta, cyan, or black is formed on the peripheral surface of each photosensitive drum 11. These toner images are respectively superposed on and transferred to the intermediate transfer belt 5 by a transfer bias applied to the primary transfer roller 14.

Reference numeral 16 denotes the secondary transfer roller 16 disposed below the fixing unit 8 in the state of abutting the intermediate transfer belt 5. The recording sheet P conveyed from the sheet storage unit 6 or the manual sheet feeding unit 7 along a sheet conveyance path 17 is interposed between the secondary transfer roller 16 and the intermediate transfer belt 5 and the toner images on the intermediate transfer belt 5 are transferred to the recording sheet P by a transfer bias applied to the secondary transfer roller 16. In this way, the secondary transfer roller 16 and the intermediate transfer belt 5 constitute a transfer unit.

A cleaning device 30 is disposed on the upper side of the intermediate transfer belt 5. The cleaning device 30 removes residual toner (toner remaining on the belt surface without being transferred to the recording sheet P) attached to the surface of the intermediate transfer belt 5.

The fixing unit 8 includes a fixing roller 81 and a pressure roller 82 and is unitized. The pressure roller 82 is brought into press-contact with the fixing roller 81. The recording sheet P is interposed by the fixing roller 81 and pressure roller 82 so as to be pressurized and heated, so that the toner images transferred to the recording sheet P are fixed to the recording sheet P. The recording sheet P subjected to the fixing process is discharged to the sheet discharge unit 9. Reference numeral 20 denotes a reverse conveyance path for reversing the recording sheet P discharged from the fixing unit 8 during duplex printing.

[Configuration of Cleaning Device 30]

Figure 2:
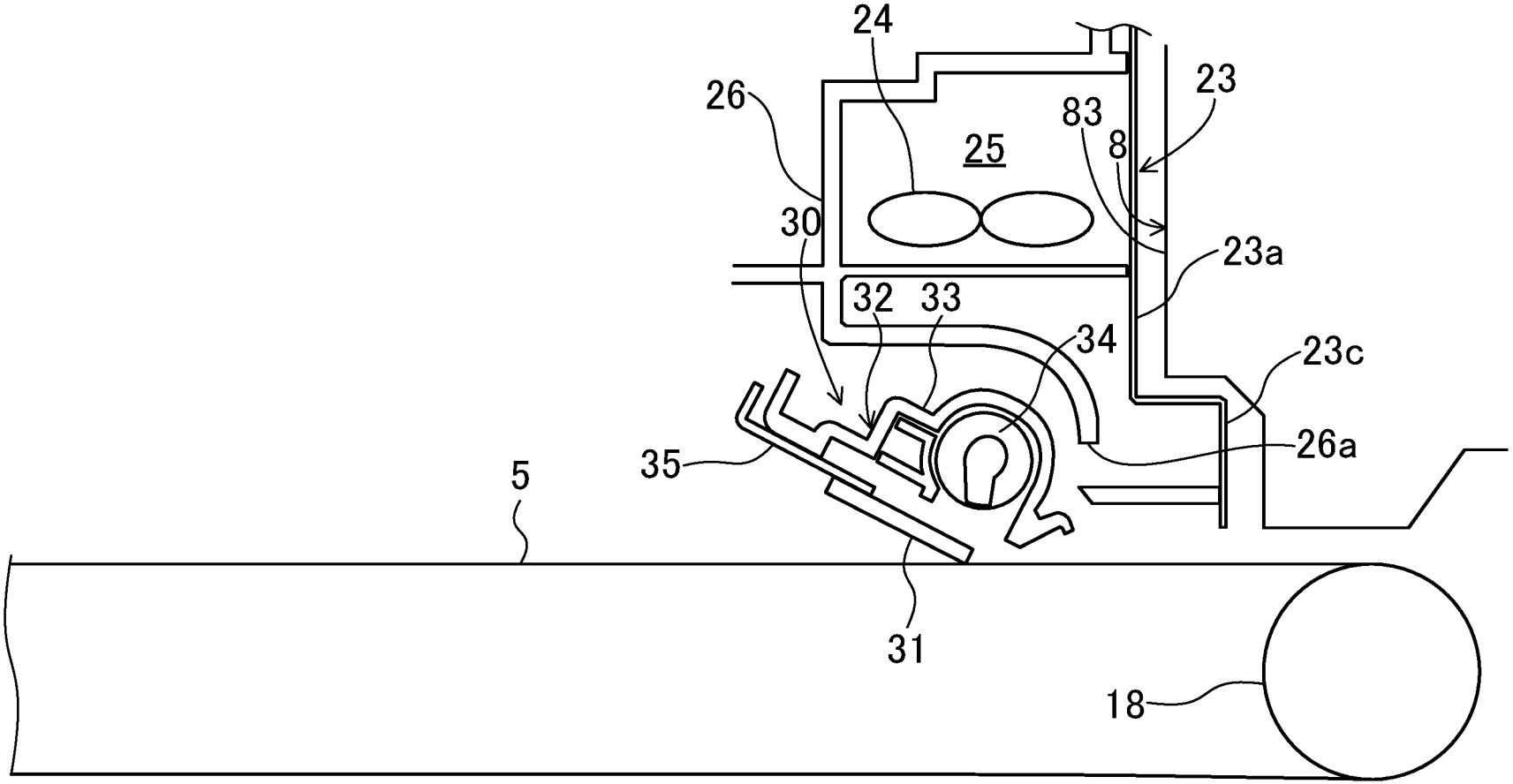
FIG. 2 is an enlarged view illustrating the periphery of a cleaning device including a waste toner unit.

FIG. 2 is an enlarged section view of the cleaning device 30. The cleaning device 30 is provided at an upper side of and on the end part of the intermediate transfer belt 5 of the secondary transfer roller 16 side.

The cleaning device 30 has a cleaning member 31 and a waste toner unit 32. The cleaning member 31 is configured with a blade having a distal end part that abuts the upper surface of the intermediate transfer belt 5. The cleaning member 31 extends over the entire width direction of the intermediate transfer belt 5 (the front and rear direction of the image forming apparatus 1). The cleaning member 31 scrapes and removes residual toner attached to the upper surface of the intermediate transfer belt 5. It is noted that the cleaning member 31 is not limited to the blade and for example, may be a sliding roller, which is in sliding contact with the upper surface of the intermediate transfer belt 5, and the like.

The waste toner unit 32 is provided adjacent to an upper side of the cleaning member 31. The waste toner unit 32 has a resinous housing 33 that receives a conveying screw 34 extending in the front and rear direction. The cleaning member 31 is attached to the housing 33 via a bracket 35. Accordingly, the toner scraped off by the cleaning member 31 is introduced into the waste toner unit 32 and then is discharged to a waste toner tank (not illustrated) by the conveying screw 34.

[Air Cooling of Waste Toner Unit 32]

With reference to FIG. 2, an air cooling structure of the waste toner unit 32 will be described. An air blowing fan 24 is provided on a sidewall of the casing 2 of the image forming apparatus 1 to cool the inside of the casing 2. In the present embodiment, air introduced from the outside of the apparatus by the air blowing fan 24 is also used for cooling the waste toner unit 32.

The air blowing fan 24 is disposed at an end (rear end) of an air passage 25 extending in the casing 2 in the front and rear direction. When the air blowing fan 24 is operated, air flows in the air passage 25. The air passage 25 is formed by a body stay 23 and an air passage forming member 26. The air passage forming member 26 is a resin member extending in the front and rear direction and opened rightward.

The air passage forming member 26 is formed at the lower end part thereof with a ventilation hole **26*a*. The ventilation hole 26*a* allows a space in the air passage 25 and a space on the side of the waste toner unit 32 outside the space in the air passage 25 communicate with each other. A part of the air flowing in the air passage 25 is guided to the side of the waste toner unit 32 through the ventilation hole 26*a*. In this way, the waste toner unit 32 is cooled by the air flow that flows from the ventilation hole 26*a* to the side of the waste toner unit 32**.

[Configuration of Fixing Unit and Body Stay]

Figure 3:
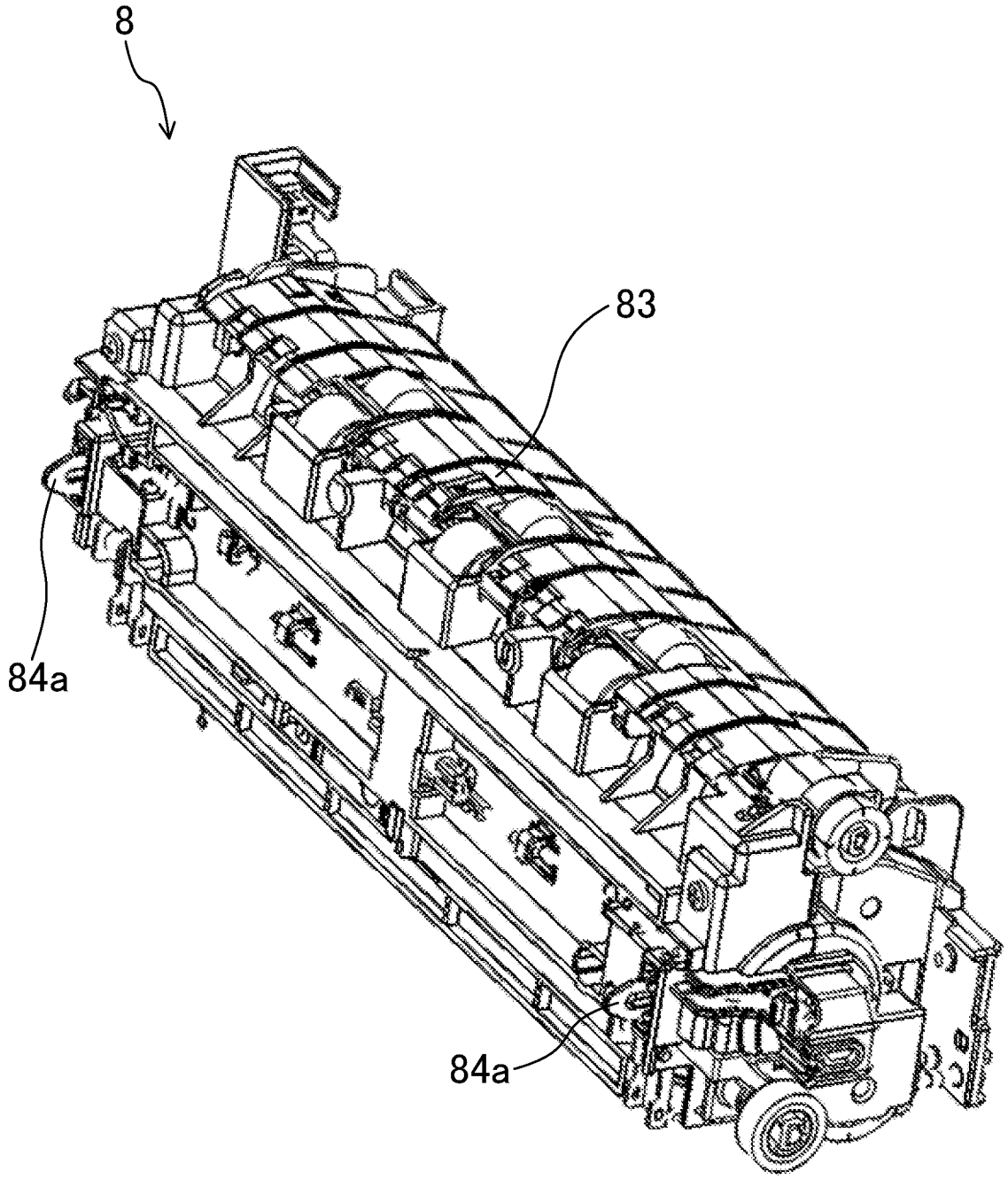
FIG. 3 is an external appearance perspective view illustrating a fixing unit.

As illustrated in FIG. 3, the fixing unit 8 has a housing 83 that receives the fixing roller 81 and the pressure roller therein. The housing 83 is formed in a rectangular box shape that is long in the front and rear direction. The housing 83 is attached to the body stay 23 (see FIG. 4) in a state in which the longitudinal direction (front and rear direction) of the housing 83 is approximately horizontal. Positioning pieces **84*a* protrude from both end parts of the housing 83 in the longitudinal direction. The positioning pieces 84*a* are formed on support sheet metals 84 (see FIG. 7) that support both ends of the fixing roller 81**.

Figure 4:
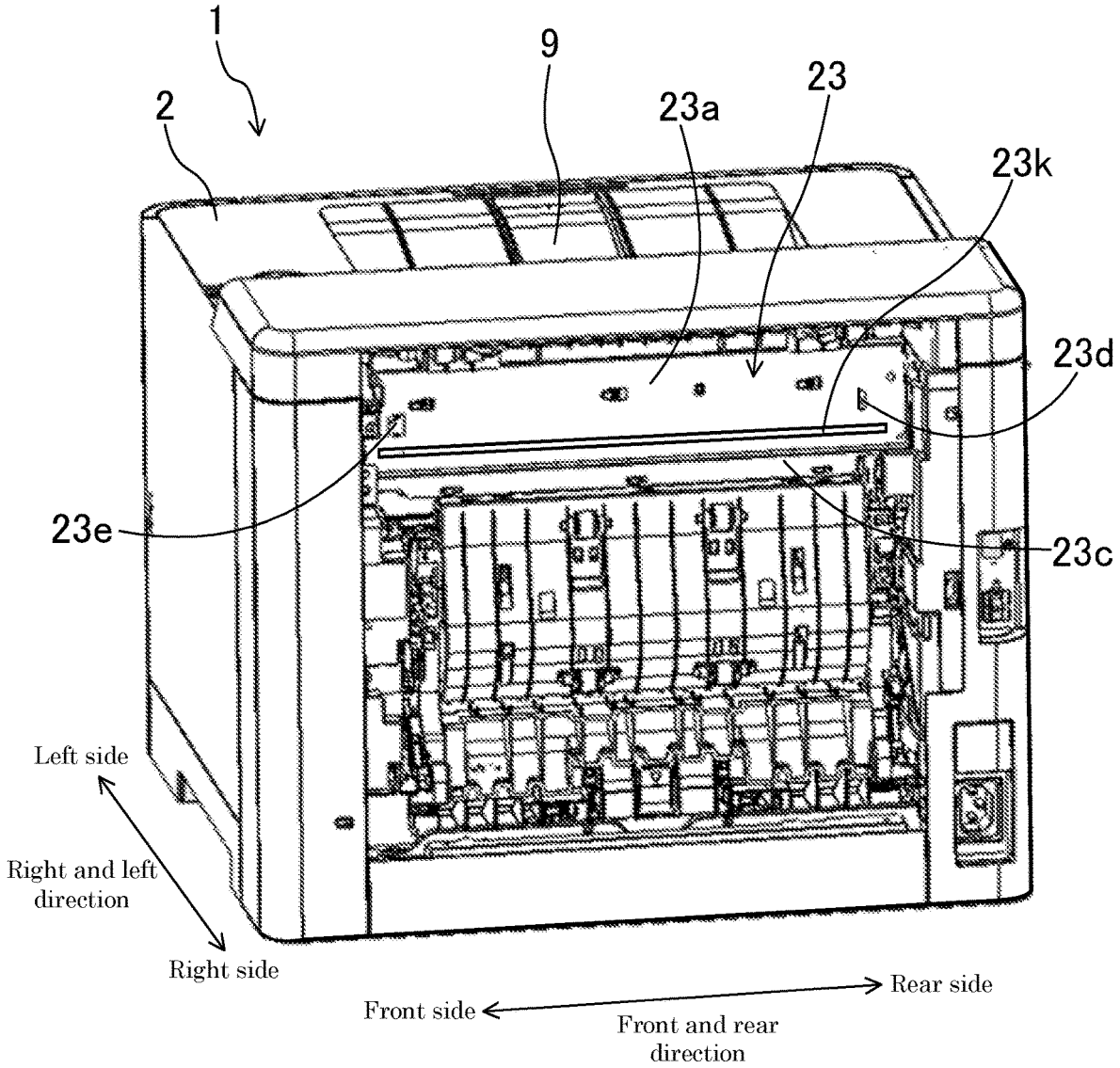
FIG. 4 is an external appearance perspective view illustrating a state in which a right cover of the image forming apparatus is removed.
Figure 5:
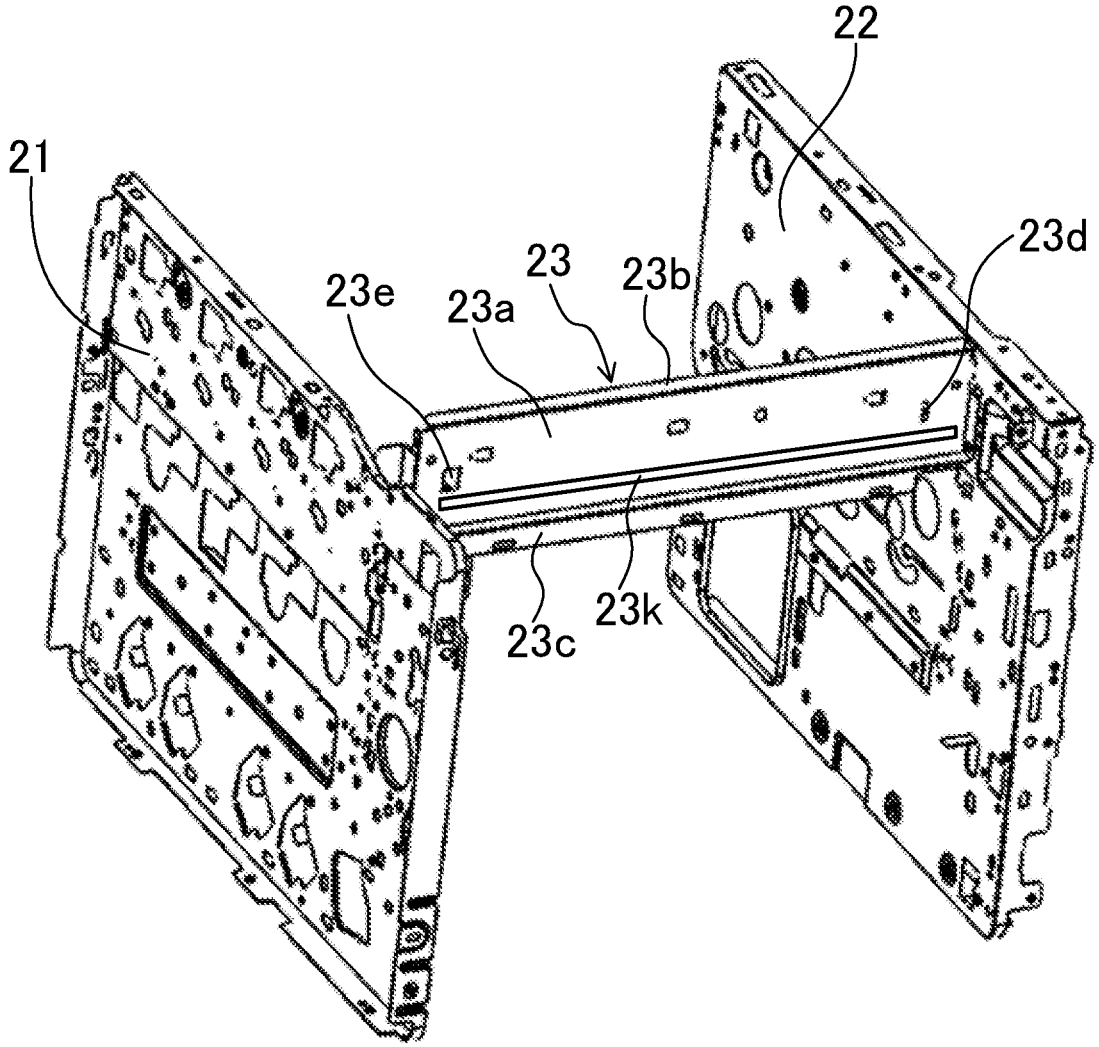
FIG. 5 is a perspective view when viewed from a front oblique right side, which illustrates a frame configuration of the image forming apparatus.

As illustrated in FIG. 4 and FIG. 5, the body stay 23 is provided in the casing 2 of the image forming apparatus 1 to fix the fixing unit 8. Preferably, the body stay 23 is a member having a higher thermal conductivity and a lower emissivity than resin and the like. In the present embodiment, the body stay 23, for example, is made of an aluminum material.

The body stay 23 includes a sheet metal member extending in the front and rear direction (same direction as the longitudinal direction of the fixing unit 8). Both end parts of the body stay 23 in the front and rear direction are connected and fixed to a front frame plate 21 and a rear frame plate 22 (frame members), respectively, as illustrated in FIG. 5.

Figure 6:
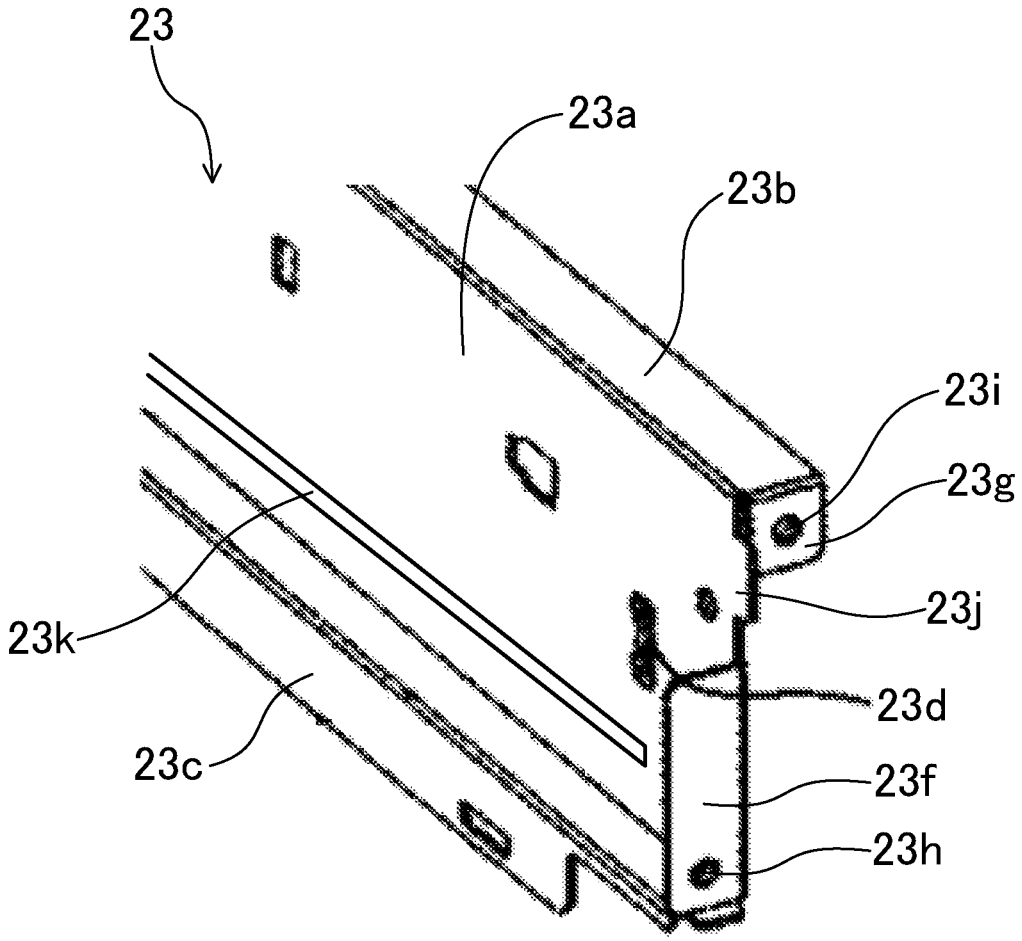
FIG. 6 is an enlarged view illustrating a rear end part of a body stay.

As illustrated in FIG. 6, at each of the front end part and the rear end part of the body stay 23, two bending pieces **23*f* and 23*g* (abutting pieces) are formed to abut the front frame plate 21 and the rear frame plate 22 by surface contact. Between the two bending pieces 23*f* and 23*g* in the body stay 23, a rectangular engaging piece 23*j* is formed to engage with a connection hole (not illustrated) formed in each of the frame plates 21 and 22. Although FIG. 6 illustrates only the rear end part of the body stay 23**, the front end part also has the same configuration.

The bending pieces 23*f* and 23*g* are formed with mounting holes 23*h* and 23*i*, respectively. The body stay 23 is fixed to the frame plates 21 and 22 by screws inserted thorough the mounting holes 23*h* and 23*i*.

Furthermore, the body stay 23 is formed with a pair of engagement holes 23*d* and 23*e* (see FIG. 4 and FIG. 5) that engage with the positioning pieces 84*a* of the fixing unit 8.

The pair of engagement holes 23*d* and 23*e* are formed at both end parts of the body stay 23 in the front and rear direction. The width of the rear engagement hole 23*d* is set to be approximately the same as or slightly smaller than the thickness of the positioning piece 84*a* (thickness in the front and rear direction). The width of the front engagement hole 23*e* is set to be slightly larger than the thickness of the positioning piece 84*a* in the front and rear direction. In this way, while the front engagement hole 23*e* absorbs the extension of the fixing unit 8 in the front and rear direction due to temperature rise, the rear engagement hole 23*d* regulates the position of the fixing unit 8 in the front and rear direction. The pair of engagement holes 23*d* and 23*e* correspond to positioning parts that perform the positioning of the fixing unit 8.

Figure 7:
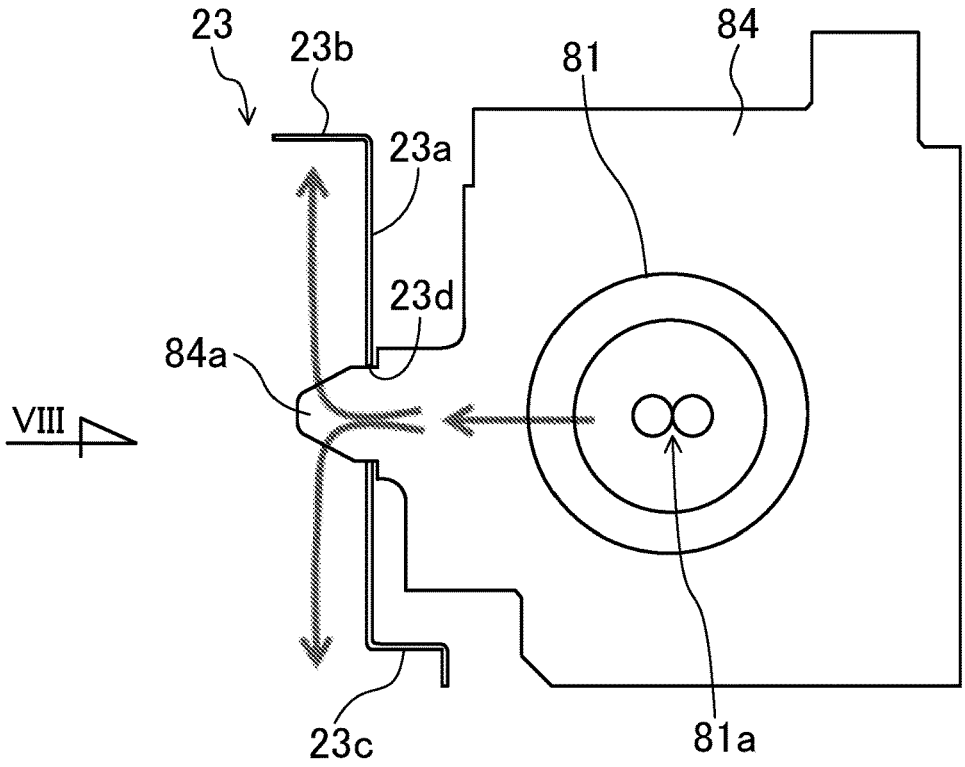
FIG. 7 is a schematic view illustrating a state in which a support sheet metal of the fixing unit is engaged with and fixed to the body stay.

FIG. 7 illustrates a state in which the positioning piece 84*a* formed on the support sheet metals 84 that support the rear end part of the fixing roller 81 engages with the engagement hole 23*d* of the body stay 23.

The body stay 23 has a vertical plate part 23*a* extending in the vertical direction, an upper horizontal part 23*b* horizontally protruding from an upper end edge of the vertical plate part 23*a*, and a lower L-shaped part 23*c* connected to a lower end edge of the vertical plate part 23*a*. The pair of engagement holes 23*d* and 23*e* (FIG. 7 illustrates only the engagement hole 23*d*) are formed in the vertical plate part 23*a*. The vertical plate part 23*a* corresponds to an opposing wall facing the fixing unit 8.

Figure 8:
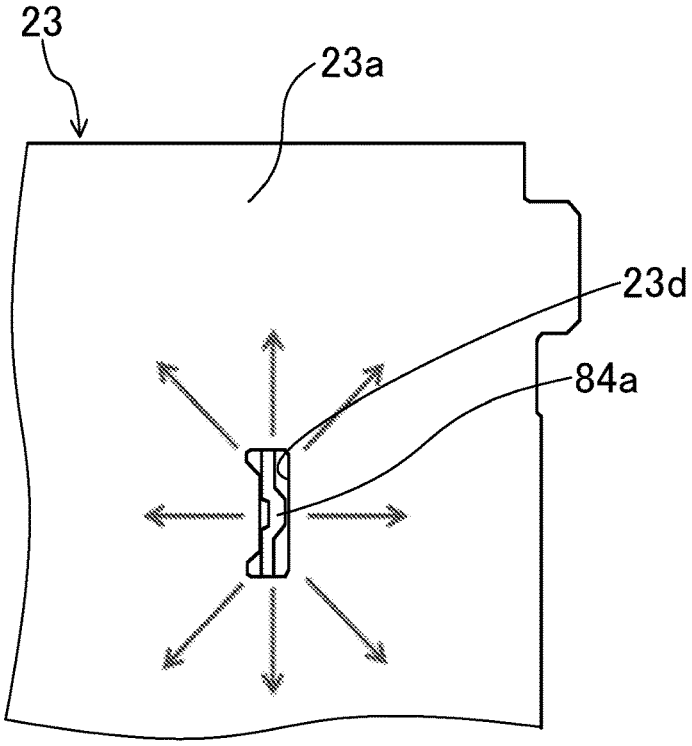
FIG. 8 is a view in the direction of the arrow VIII of FIG. 7.

FIG. 8 is a view in the direction of the arrow VIII of FIG. 7. As illustrated in FIG. 8, when the positioning piece 84*a* is viewed from the distal end side in the protruding direction thereof, a center part is bent in a trapezoidal shape. Furthermore, when viewed from the distal end side, the positioning piece 84*a* abuts an inner side surface of the engagement hole 23*d* at three places, that is, both end parts in the vertical direction and the center part.

In FIG. 7 and FIG. 8, thick line arrows indicate heat transmission paths. Heat generated by a heater 81*a* (a heating part) in the fixing roller 81 is transmitted to the support sheet metal 84. The support sheet metal 84 is connected to the body stay 23 by the positioning piece 84*a* as described above. Therefore, the heat transmitted from the heater 81*a* to the support sheet metal 84 is transmitted to the body stay 23 through the positioning piece 84*a*. When the transmitted heat is transmitted to the lower end part (the lower L-shaped part 23*c*) of the body stay 23, the devices (the cleaning device 30 and the driving roller 18) disposed around the lower end part may be damaged.

In order to prevent such a problem, the body stay 23 is provided with a slit hole 23*k* (an example of a chipped part) for blocking the transmission of the heat transmitted from the fixing unit 8 to the body stay 23.

Figure 9:
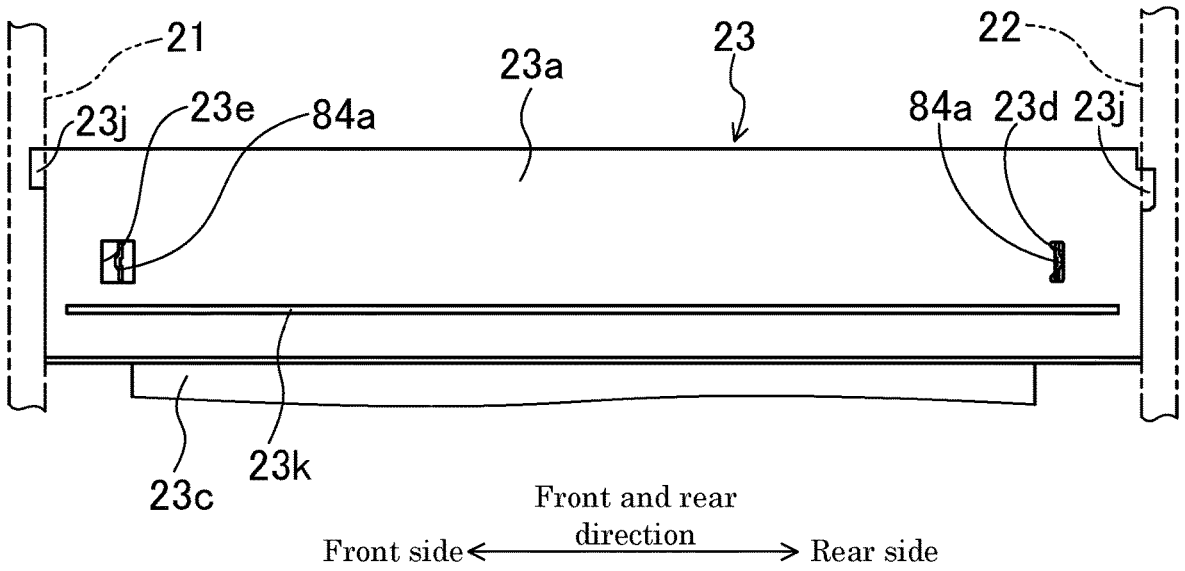
FIG. 9 is a schematic view when the body stay is viewed from a unit mounting surface.

As illustrated in FIG. 9, the slit hole 23*k* is formed in the vertical plate part 23*a* of the body stay 23. The slit hole 23*k* is formed in a rectangular shape that is long in the front and rear direction (the width direction of the vertical plate part 23*a*). The slit hole 23*k* is formed below the pair of engagement holes 23*d* and 23*e* (positioning parts) in the vertical plate part 23*a*. The slit hole 23*k* extends over the entire front and rear direction (width direction) of the vertical plate part 23*a*.

Preferably, both end parts of the slit hole 23*k* in the front and rear direction are positioned directly below or on the outside rather than directly below the pair of engagement holes 23*d* and 23*e*. In the present embodiment, both end parts of the slit hole 23*k* in the front and rear direction are positioned on the outside rather than directly below the pair of engagement holes 23*d* and 23*e* and in the vicinity of both end edges of the vertical plate part 23*a* in the front and rear direction.

[Operation Effects]

As described above, in the present embodiment, the slit hole 23*k* is formed below the pair of engagement holes 23*d* and 23*e* in the body stay 23.

According to this, the transmission paths (see FIG. 7 and FIG. 8) of the heat transmitted from the fixing unit 8 to the body stay 23 are blocked by the slit hole 23*k*. Consequently, since the heat is not transmitted under the slit hole 23*k*, it is possible to suppress the temperature rise at the lower end part of the body stay 23. As a consequence, it is possible to suppress the temperature rise of the cleaning device 30 (the waste toner unit 32) and the driving roller 18 disposed around the lower end part of the body stay 23. Accordingly, it is possible to prevent the devices from malfunctioning due to fusion of toner in the waste toner unit 32 or fusion of scattered toner attached to the surface of the driving roller 18.

Furthermore, the slit hole 23*k* extends in the same direction as the longitudinal direction (front and rear direction) of the fixing unit 8 and is formed over approximately the entire front and rear direction of the body stay 23.

According to such a configuration, the heat generated from the fixing unit 8 serving as a heat source can be blocked in approximately the entire area of the body stay 23 in the front and rear direction.

Furthermore, since both end edges of the slit hole 23*k* in the front and rear direction are positioned outside the pair of engagement holes 23*d* and 23*e*, the heat transmission paths between the pair of positioning pieces 84*a* (the engagement holes 23*d* and 23*e*) of the fixing unit 8 and the lower end part of the body stay 23 can be reliably blocked by the slit hole 23*k*.

Furthermore, both end parts of the body stay 23 in the front and rear direction are fixed in contact with the front frame plate 21 and the rear frame plate 22 of the image forming apparatus 1, the body stay 23 is made of an aluminum material, and each of the frame plates 21 and 22 is made of an iron material. As described above, the body stay 23 and each of the frame plates 21 and 22 are both configured with members having a higher thermal conductivity than resin and the like, so that the heat transmitted from the fixing unit 8 to the body stay 23 can be released to each of the frame plates 21 and 22. Thus, before the heat from the fixing unit 8 is transmitted to the lower end part of the body stay 23, the heat is released to each of the frame plates 21 and 22, so that it is possible to effectively suppress the temperature rise at the lower end part of the body stay 23.

Furthermore, since the aluminum material constituting the body stay 23 has a lower emissivity than resin and the like, the amount of radiant heat transmission received in the body stay 23 from the fixing unit 8 can be kept low. Thus, it is possible to suppress the temperature rise at the lower end part of the body stay 23 as much as possible.

<<Modification 1>>

Figure 10:
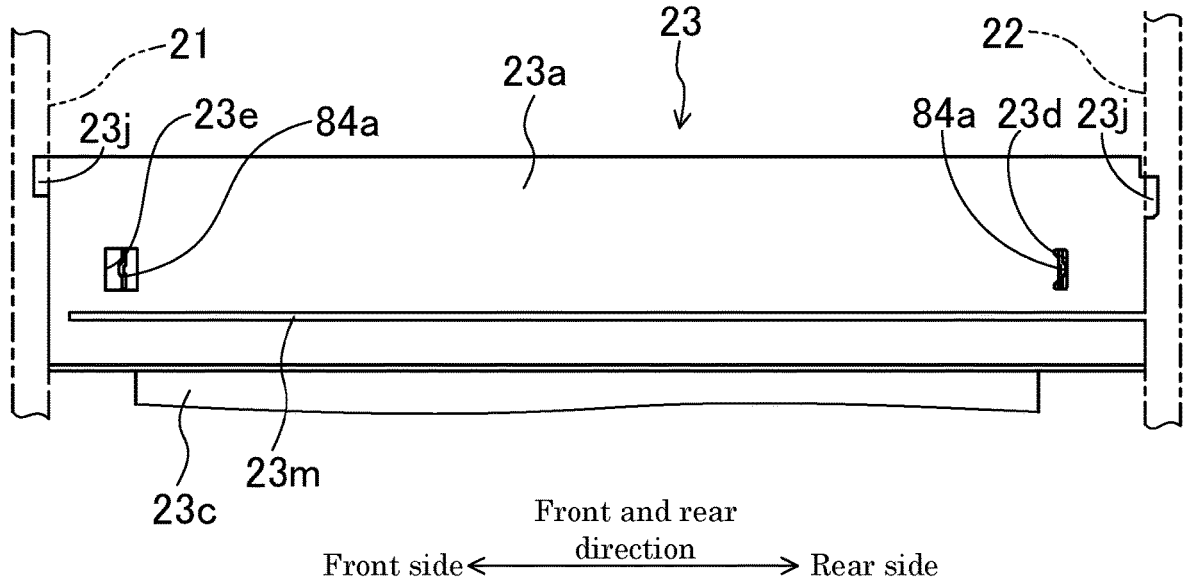
FIG. 10 is a view corresponding to FIG. 9, which illustrates a modified example 1.

FIG. 10 is a view corresponding to FIG. 9, which illustrates a modified example 1. In the modified example 1, the configuration of a chipped part provided on the lower side of the pair of engagement holes 23*d* and 23*e* in the body stay 23 is different from that of the aforementioned embodiment.

That is, in the aforementioned embodiment, the chipped part is configured by the rectangular slit hole 23*k* extending in the front and rear direction. However, in the present modified example 1, the chipped part is configured by a notched part 23*m* opened to one side (rear side in the example of FIG. 10) in the front and rear direction.

According to such a configuration, it is possible to widen a heat blocking area as compared with the aforementioned embodiment. Thus, it is possible to more reliably obtain the same operation effects as the aforementioned embodiment.

<<Modification 2>>

Figure 11:
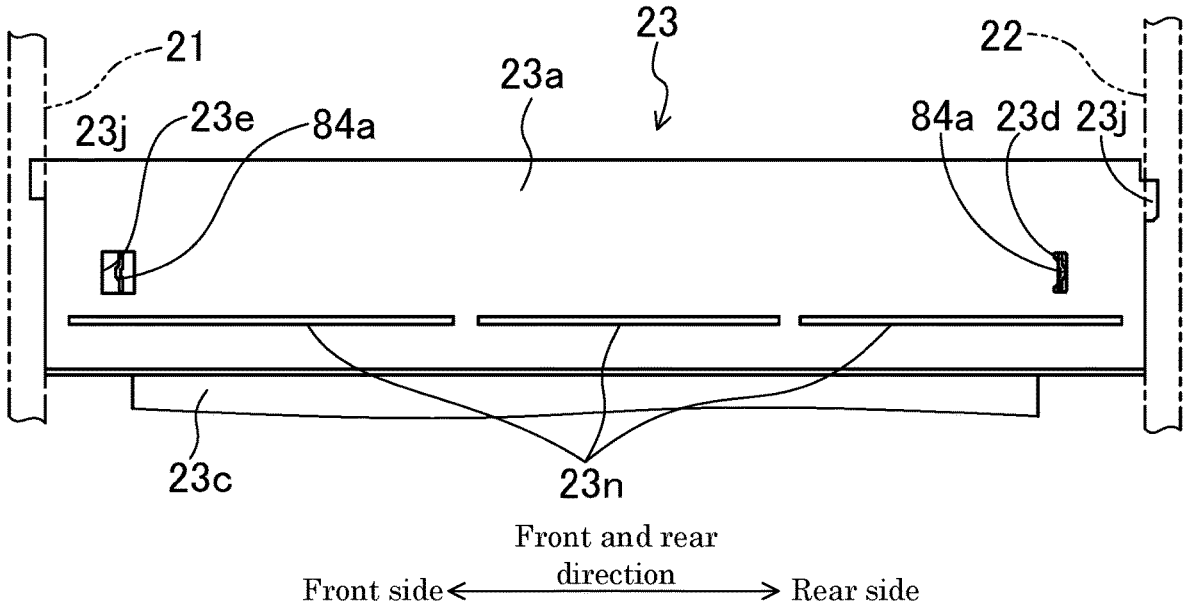
FIG. 11 is a view corresponding to FIG. 9, which illustrates a modified example 2.

FIG. 11 is a view corresponding to FIG. 9, which illustrates a modified example 2. In the modified example 2, the configuration of a chipped part provided in the body stay is different from those of the aforementioned embodiment and modified example 1.

That is, in the present modified example 2, the chipped part is configured by a plurality of (three in the present embodiment) slit holes 23*n* arranged in the front and rear direction.

According to such a configuration, it is possible to obtain the same operation effects as the embodiment while ensuring the strength of the present body stay 23.

Other Embodiments

The aforementioned each embodiment employs the intermediate transfer system in which the toner image on the peripheral surface of each photosensitive drum 11 is primarily transferred to the intermediate transfer belt 5 and then is secondarily transferred to the recording medium P; however, the technology of the present disclosure is not limited thereto and it may also be possible to employ the direct transfer system in which the toner image on the peripheral surface of the photosensitive drum 11 is directly transferred to the recording medium P. In such a case, the photosensitive drum 11 serves as an image carrying member. Furthermore, the number of photosensitive drums 11 may be one.

Furthermore, in the aforementioned each embodiment, the waste toner unit 32 is configured to convey waste toner in the axial direction by the conveying screw 34; however, the technology of the present disclosure is not limited thereto. The waste toner unit 32 does not have to have the conveying screw 34 and only needs to store the waste toner.

What is claimed is:

1. An image forming apparatus comprising:

an image carrying member including a transfer belt or a photosensitive drum;

a transfer unit configured to transfer a toner image carried on the image carrying member to a recording medium;

a fixing unit disposed above the transfer unit and configured to heat and pressurize the toner image transferred to the recording medium and fix the toner image to the recording medium;

a body stay having an opposing wall facing a side surface of the fixing unit; and a positioning part provided on the opposing wall and configured to perform positioning of the fixing unit, wherein a chipped part is provided below the positioning part in the body stay and blocks transmission of heat transmitted from the fixing unit to the body stay via the positioning part.

2. The image forming apparatus of claim 1, wherein the fixing unit is configured to be attached to the body stay in a state in which a longitudinal direction is approximately horizontal, the body stay extends in a direction equal to the longitudinal direction of the fixing unit, and the chipped part includes a slit hole that is provided below the positioning part and extends over approximately an entire extension direction of the body stay.

3. The image forming apparatus of claim 1, wherein the fixing unit is configured to be attached to the body stay in a state in which a longitudinal direction is approximately horizontal, the body stay extends in a direction equal to the longitudinal direction of the fixing unit, and the chipped part includes a notched part that is provided below the positioning part, extends over approximately an entire extension direction of the body stay, and is opened to one side in the extension direction.

4. The image forming apparatus of claim 1, wherein the fixing unit is configured to be attached to the body stay in a state in which a longitudinal direction is approximately horizontal, the body stay extends in a direction equal to the longitudinal direction of the fixing unit, the chipped part includes a plurality of slit holes that are provided below the positioning part and arranged in an extension direction of the body stay, and the plurality of slit holes are arranged in an entire extension direction of the body stay.

5. The image forming apparatus of claim 1, wherein the fixing unit is configured to be attached to the body stay in a state in which a longitudinal direction is approximately horizontal, the body stay extends in a direction equal to the longitudinal direction of the fixing unit, both end parts in an extension direction of the body stay are fixed in contact with a frame member of the image forming apparatus, and the body stay and the frame member include members having a higher thermal conductivity than resin.

6. The image forming apparatus of claim 5, wherein abutting pieces are formed at both end parts in the extension direction of the body stay to abut the frame member by surface contact.

7. The image forming apparatus of claim 1, wherein the fixing unit comprises:

a fixing roller heated by a heating part;

a pressure roller brought into press-contact with the fixing roller; and a sheet metal member configured to support both ends of the fixing roller, wherein a positioning piece configured by a part of the sheet metal member protrudes from the side surface of the fixing unit, and the positioning part includes an engagement hole that engages with the positioning piece.

8. The image forming apparatus of claim 1, wherein the body stay includes a member having a lower emissivity than resin.

* * * * *